US008289207B2

(12) United States Patent
Booton et al.

(10) Patent No.: US 8,289,207 B2
(45) Date of Patent: Oct. 16, 2012

(54) METHOD FOR LOCATING SATELLITES USING DIRECTIONAL FINDING

(75) Inventors: Richard Booton, Fairport, NY (US); Timothy Snell, Penfield, NY (US); William Tyler, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 329 days.

(21) Appl. No.: 12/770,840

(22) Filed: Apr. 30, 2010

(65) Prior Publication Data

US 2011/0268159 A1 Nov. 3, 2011

(51) Int. Cl.
*H01Q 3/00* (2006.01)
*H04B 7/185* (2006.01)

(52) U.S. Cl. ..... 342/359; 342/353

(58) Field of Classification Search ..... 342/76, 342/353, 359, 436, 443, 754, 757; 375/146; 343/754, 757

See application file for complete search history.

(56) References Cited

U.S. PATENT DOCUMENTS 3,496,500 A 2/1970 Romary
5,167,535 A 12/1992 Kovacik et al.
6,433,445 B1 8/2002 Ahladas et al.
6,934,327 B1 8/2005 Whited et al.
2002/0157932 A1 10/2002 DeWitt et al.
2004/0036273 A1 2/2004 McClary

FOREIGN PATENT DOCUMENTS

DE 102006047039 11/2007
DE 202008009929 12/2009

OTHER PUBLICATIONS

Search Report for European App. No. EP 11 00 8531 dated Nov. 24, 2011.

M. Miller et al, "An Innovative Synchronization Preamble for UHF MILSATCOM", Copyright 1999 IEEE.

*Primary Examiner* — Dao Phan

(74) *Attorney, Agent, or Firm* — Harness, Dickey & Pierce, PLC

(57) ABSTRACT

An improved method is provided for positioning a directional antenna coupled to a radio towards a satellite. The method includes: receiving an input to the radio from an operator of the radio, where the input indicates a desired time period for positioning the antenna; transmitting, during the desired time period, a plurality of burst data transmissions from the radio over a channel associated with the satellite; receiving a plurality of reply data transmissions from the satellite which correspond to the plurality of burst data transmissions sent by the radio; determining a metric indicative of signal quality for each of the reply data transmissions; and outputting from the radio an indicator for each metric. The operator of the radio can use the indicator output by the radio to better position the antenna towards the satellite.

19 Claims, 7 Drawing Sheets

METHOD FOR LOCATING SATELLITES USING DIRECTIONAL FINDING

FIELD

The present disclosure relates to a method for positioning a directional antenna coupled to a radio towards a satellite.

BACKGROUND

Tactical radio operators that operate radios having satellite communications capability need to be able to easily and quickly find a desired satellite. These types of radios typically utilize a directional antenna to transmit signals to the satellite. Thus, the radio operator needs to position or point the antenna towards the satellite. In some instances, the radio is equipped with functionality to help the operator to position the antenna and to thereby improve the link quality with the satellite. However, existing techniques for assisting the radio operator have several drawbacks, including inconsistent results and poor or slow operator feedback.

Therefore, it is desirable to provide an improved method for positioning a directional antenna coupled to a radio towards a satellite.

SUMMARY

An improved method is provided for positioning a directional antenna coupled to a radio towards a satellite. The method includes: receiving an input to the radio from an operator of the radio, where the input indicates a desired time period for positioning the antenna; transmitting, during the desired time period, a plurality of burst data transmissions from the radio over a channel associated with the satellite; receiving a plurality of reply data transmissions from the satellite which correspond to the plurality of burst data transmissions sent by the radio; determining a metric indicative of signal quality for each of the reply data transmissions; and outputting from the radio an indicator for each metric. The operator of the radio can use the indicator output by the radio to better position the antenna towards the satellite.

An improved method for determining link quality is also described in this disclosure. A positioning signal having a repeating pattern of locating data bits is generated and modulated using a digital modulation scheme, such as a minimum-shift keying method. The positioning signal is transmitted from the radio to the satellite and a reply signal corresponding to the positioning signal is received by the radio. The reply signal is transformed from a time domain to values in a frequency domain and a metric indicative of link quality is determined from the values in the frequency domain.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

Figure 1:
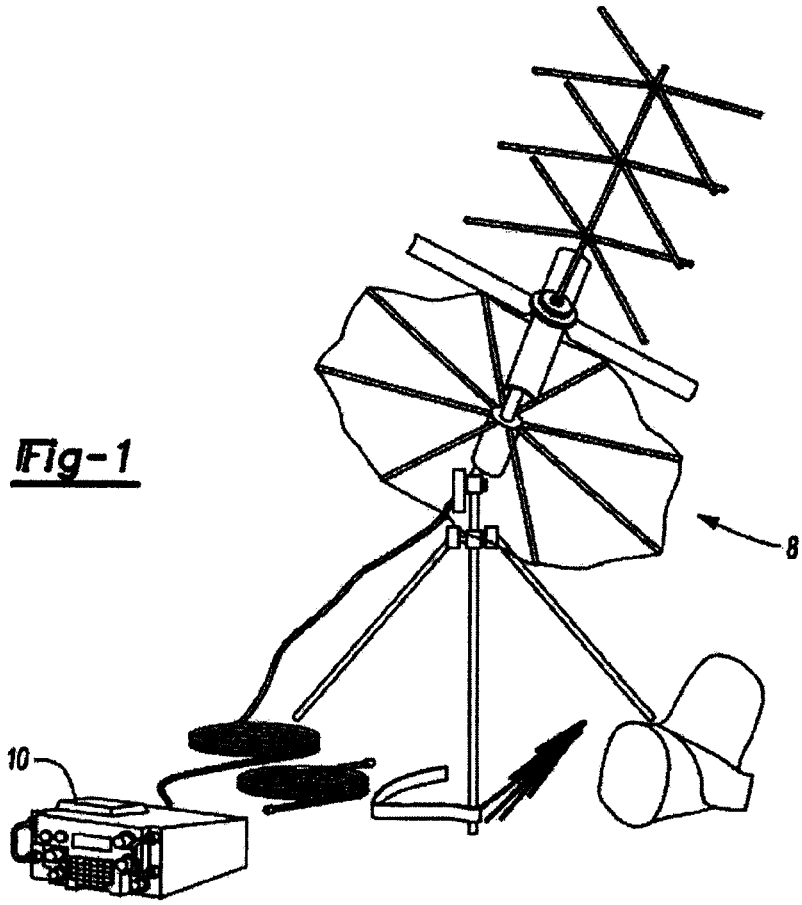
FIG. 1 illustrates an exemplary arrangement of a radio operably coupled to a directional antenna.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

FIG. 1 illustrates an exemplary arrangement of a radio 10 operably coupled to a directional antenna 8. Exemplary radios may include a handheld radio or a manpack radio from the Falcon III series of radio products commercially available from Harris Corporation. Other types of radios are also contemplated by this disclosure. Moreover, this disclosure contemplates other types of wireless communication devices which may use a directional antenna.

Figure 2:
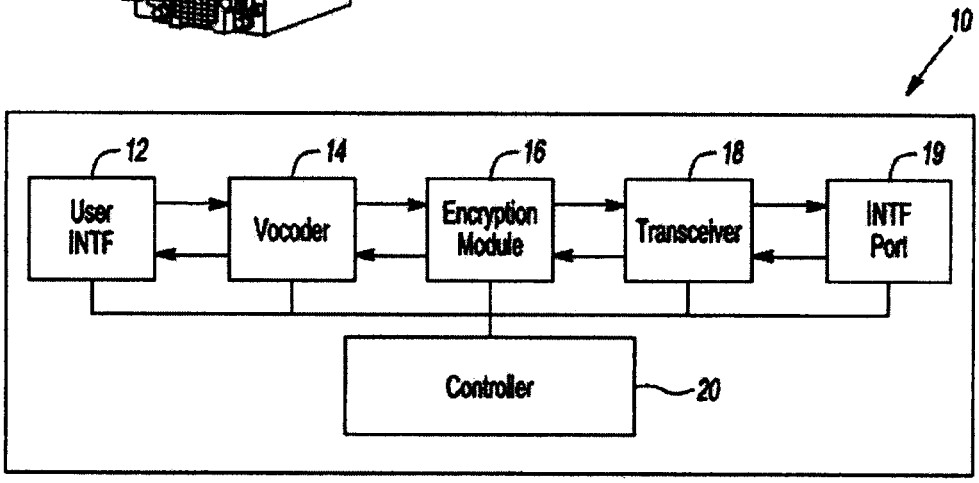
FIG. 2 is a diagram depicting an exemplary configuration for a radio.

FIG. 2 depicts an exemplary configuration for a radio 10. The radio 10 is comprised generally of a user interface 12, a vocoder, 14, an encryption module 16, a transceiver 18, and a control module or controller 20. Each of these radio components, along with other preferred components, is further described below. As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality. It is to be understood that the most relevant components are discussed below, but that other known components (e.g., power source) are needed to control and manage the overall operation of the radio. Within the broader aspects of the disclosure, it is also envisioned that these components may be arranged in other varying configurations.

The user interface 12 enables the radio operator to control the operations of the radio. For instance, the user interface 12 includes an audio interface for capturing voice data from the radio operator and outputting voice data to the radio operator. The user interface 12 also provides knobs or buttons for configuring operating parameters of the transceivers. For example, the operator may use the interface 12 to select the frequency at which the transceiver will operate at. In another example, the user interface 12 may include a display that assists the operator with positioning the directional antenna as further described below.

Voice data input to the audio interface may be routed through an encryption module 16 to ensure secure communication. The encryption device 16 is operable to encrypt and decrypt messages. Although various algorithms are contemplated, the encryption module preferably employs a Sierra Type 1 or a Citadel® encryption algorithm. Prior to being encrypted, voice data may also pass through a vocoder 14 which digitizes the voice data and segments it into data packets for subsequent transmission. The data packets are defined in accordance with the Internet protocol or some other type of network routing protocol. It is understood that not all data needs to be sent in packet form.

The transceiver 18 is configured to receive data packets from the encryption module 16 and transmit the data packets over a wireless communication link at a frequency in the microwave frequency spectrum. In an exemplary embodiment, the transceiver 18 is a Broadband Global Area Network (BGAN) transceiver module which operates in the L-band and is commercially available from Immarsat. While a commercially available satellite communication service is presently contemplated, it is understood that the communication link may be established using a proprietary satellite communication service. Likewise, it is contemplated that other types of transceivers at various frequency bands may be employed, including transceivers which operate in other portions of the microwave spectrum, such as the C, X, Ku or Ka band.

Alternatively, the transceiver may be configured to transmit data packets at a frequency in the radio frequency spectrum. In this case, the transceiver may be a VHF network module that operates in the frequency range from 30 MHz to 108 MHz or a UHF network module that operates in the frequency range of 300 MHz to 3 GHz. It is readily understood that other types of transceivers which utilize a wireless communication link and may require the use of a directional antenna are within the scope of this disclosure. It is also contemplated that the radio may be configured with more than one transceiver.

Figure 3:
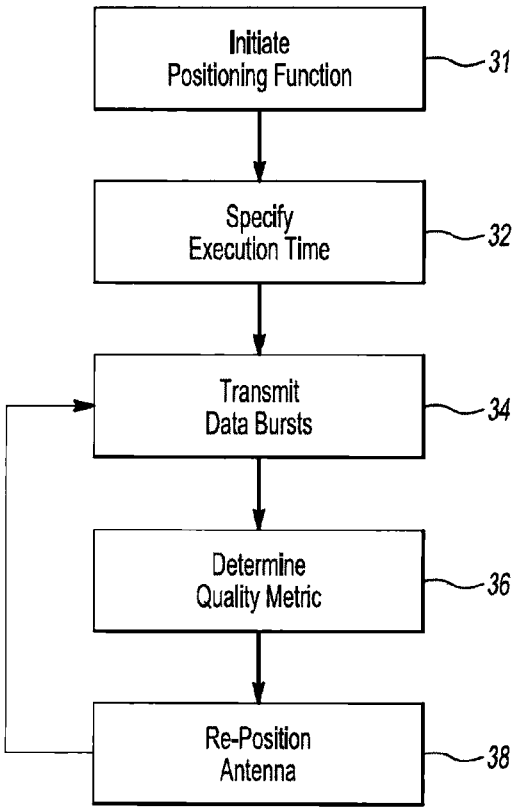
FIG. 3 is a flowchart depicting an exemplary method for positioning the directional antenna towards a satellite.

The radio 10 is configured to interface with a directional antenna. For example, the radio 10 may be equipped with an interface port 19 for detachably coupling a directional antenna 8 to the radio 10. In one exemplary scenario, the radio operator transports the directional antenna along with the portable radio. To operate the radio, the operator couples the directional antenna 8 via the interface port 19 to the radio and manually steers or points the antenna 8 towards a desired satellite. An exemplary method for positioning the directional antenna towards a satellite is further described in relation to FIG. 3. While the description makes reference to pointing the antenna towards a satellite, it is also appreciated that the antenna may be pointed towards other types of communications devices, such a nearby ground base station.

To initiate the antenna positioning process, the operator selects an antenna positioning function accessible via the user interface on the radio. The antenna positioning function may execute for a predetermined period of time. Alternatively, the operator may be prompted to input a desired time period or select from a listing of defined time periods (e.g., 15 s, 30 s or 60 s) as indicated at 32. The antenna positioning function will then execute in accordance with the specified time period. The antenna positioning function is implemented by the control module of the radio.

The radio operator first positions the antenna to a starting position. Positional information for aiming the antenna may be provided to the operator by the radio. For example, directional coordinates may be displayed on a display of the radio, where the directional coordinates are derived using a global positioning system (GPS) residing in the radio. This step may occur before or after initiating the antenna positioning function.

Next, the radio begins to transmit a plurality of burst data transmissions as indicated at 34. The burst data transmissions are used to evaluate the link quality between the radio and the satellite and therefore are transmitted over a channel associated with the satellite. Upon arrival at the satellite, the burst data transmissions are frequency shifted and retransmitted back down towards the radio. To minimize interference with existing communication of the channel, each burst transmission is on the order of 0.2 seconds. A series of data bursts allow changes in antenna position to be tracked in real-time as further described below.

Data transmissions from the satellite are in turn received and processed by the radio. Each data burst is individually processed to provide immediate feedback to the radio operator. More specifically, a metric indicative of signal quality (e.g., bit error rate or signal-to-noise ratio) may be derived at 36 from each of the reply data transmission. An indicator for the metric is then output by the radio. In some embodiments, the indicator correlates directly to the metric. For example, in the case of a signal-to-noise ratio, the signal strength in dBs may be displayed to the radio operator. In other embodiments, the value of the metric is converted to a score on a scale (e.g., 0-100) which may be more readily understood by the radio operator than the value of the metric. The score is then output by the radio. In any case, the indicator may be output visually on a display of the radio and/or audibly using a speaker of the radio. The audible indicator may be "ticks" similar to a Geiger counter, where the frequency of the ticks is directly proportional to the strength of the channel. This provide the radio operator easy-to-understand feedback without having to view a display on the radio. Other discernible means for communicating the indicator to the radio operator, such as vibrations, are also contemplated by this disclosure.

Figure 4:
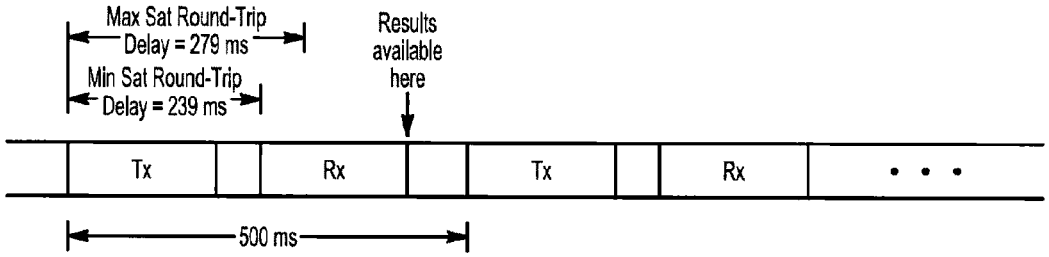
FIG. 4 is a diagram illustrating a timing sequence for the data bursts sent and received by the radio.

The operator can then re-position the antenna at 38 based on the indicator for the metric. In an exemplary embodiment, the data bursts are transmitted periodically (e.g., every 500 ms) by the radio during the time period in which the antenna positioning function is executing as shown in FIG. 4. The indicator for the metric is continually being updated and output by the radio, such that results may be generated and made available to the radio operator as the antenna is being positioned (e.g., on the order of 500 ms increments). Accuracy of the antenna position is improved by re-positioning the antenna from its starting position to maximize the value of the metric and thus the quality of the link. Moreover, this antenna positioning function reduces the amount of time needed to locate the satellite and position the antenna accordingly.

Figure 5:
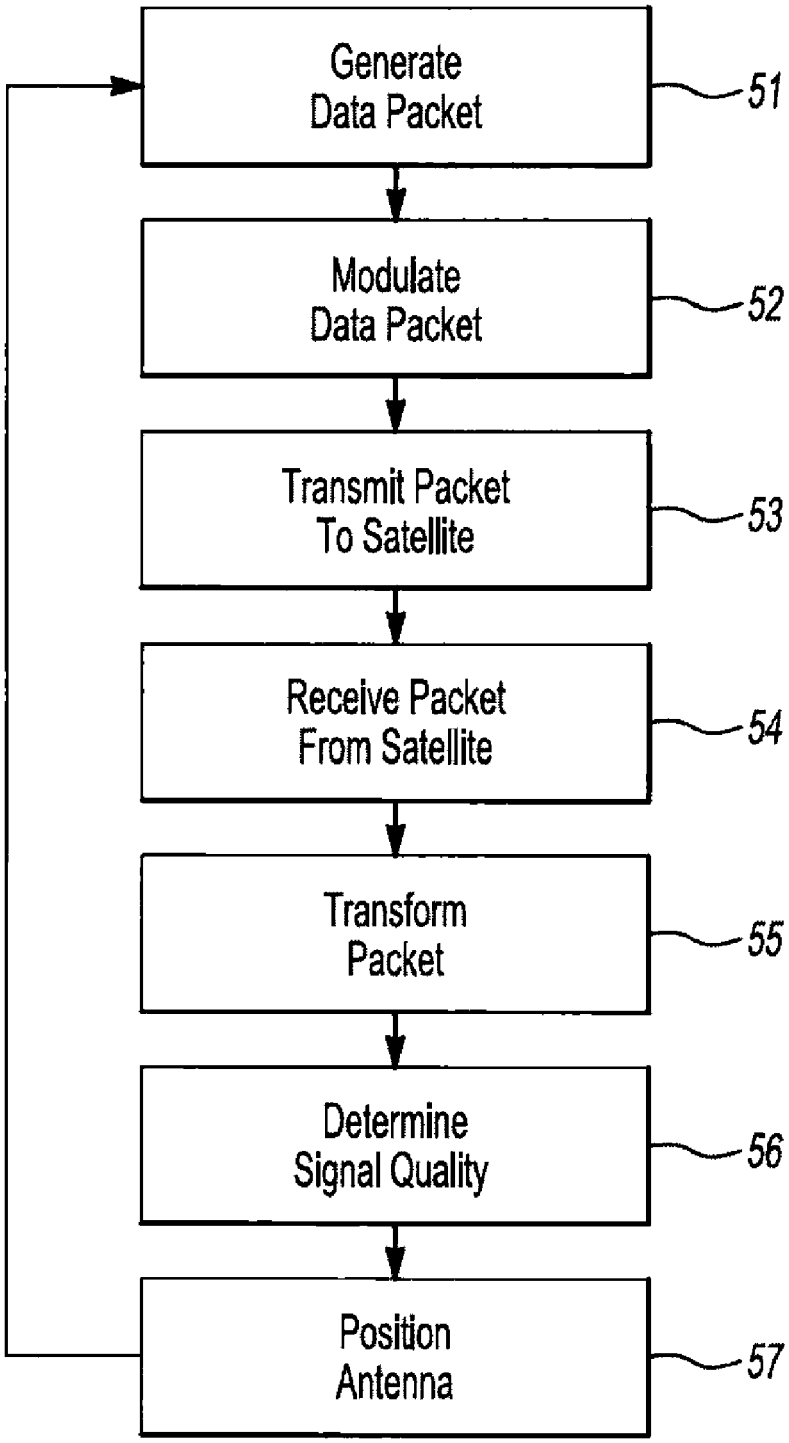
FIG. 5 is a flowchart depicting an exemplary technique for determining link quality which may be used by the antenna positioning function of the radio.

FIG. 5 illustrates an exemplary technique for determining link quality which may be used by the antenna positioning function of the radio. Briefly, the radio will transmit a known bit pattern and receive the same pattern reflected from the satellite. The known bit pattern is selected to generate a distinct frequency tone in the signal received from the satellite. By analyzing the received signal, a measure of link quality can be computed by the radio. For example, a bit error rate can be computed to determine link quality. While the description set forth herein relies upon receipt of a known bit pattern, it is readily understood that other techniques for determining link quality or signal strength may be used by the antenna positioning function and fall within the broader aspects of this disclosure.

Figure 6:
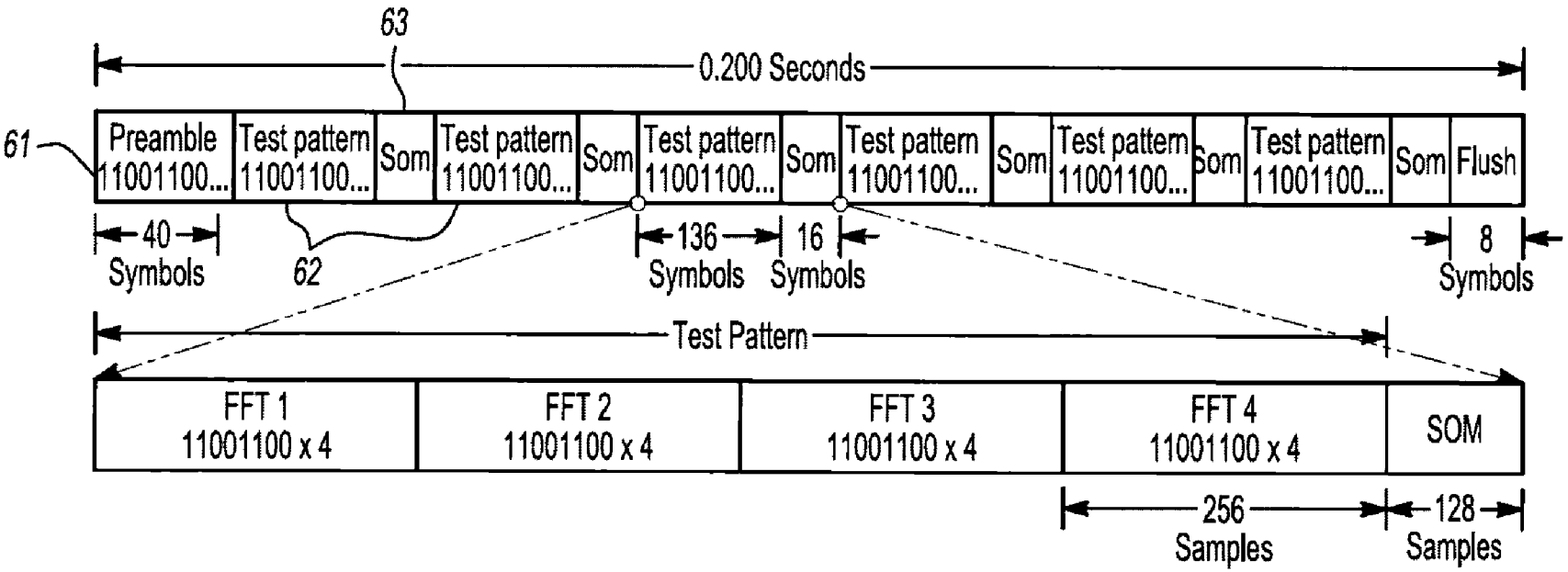
FIG. 6 illustrates an exemplary data packet format.

Upon initiating the antenna positioning function, the radio controller will generate 51 a positioning data packet. An exemplary data packet format is shown in FIG. 6. The data packet is comprised of a preamble section 61 followed by a plurality of test pattern sections 62. Each test pattern section 62 includes an alternating bit pattern of 1100 although other repeating bit patterns are also contemplated by this disclosure. A start-of-message section 63 is interposed between each of the test pattern sections. Each start-of-message section 63 includes an identifier unique to the radio. The start-of-message section 63 may be used by a given radio to process only data packets originating from that radio. Other data packet formats are also within the scope of this disclosure.

The transmission waveform is then formed by modulating the data packet 52 using a digital modulation method. A continuous phase frequency-shift keying method, such as minimum-shift keying (MSK), is preferred although other modulation schemes may be used. An MSK synchronization pattern generates a discrete set of frequency tones when a frequency transform is performed on the signal received from the satellite. More specifically, the data pattern (in this example, 1100) translates into a unique set of discrete frequency tones being transmitted to the satellite. A measure of link quality may be determined by analyzing the frequency tones embodied in the signal received from the satellite. The uniqueness and consistency in the spacing of the frequency tones is what allows the FFT processing to reliably score the reply signal from the satellite.

To look for the discrete set of frequency tones, a frequency transform, such as a fast Fourier transform (FFT), is performed at 55 on signals received 54 from the satellite by a digital signal processor residing in the radio. A measure of the signal quality is determined 56 by comparing the spectral values at the expected frequency tones to the remaining spectral values from the received signal. In an exemplary embodiment, a carrier power to noise spectral density ratio (C/No) can be computed by subtracting the sum magnitude of each frequency bin of the received signal from the sum magnitude of each of the expected frequency bins of the received signal. In this way, a metric indicative of signal quality is derived from the values in the frequency domain. It is readily understood that other types of link quality measures (e.g., a signal-to-noise ratio or an energy per bit to noise power spectral density ratio) may be derived by analyzing the spectral values for the received signal.

Figure 7:
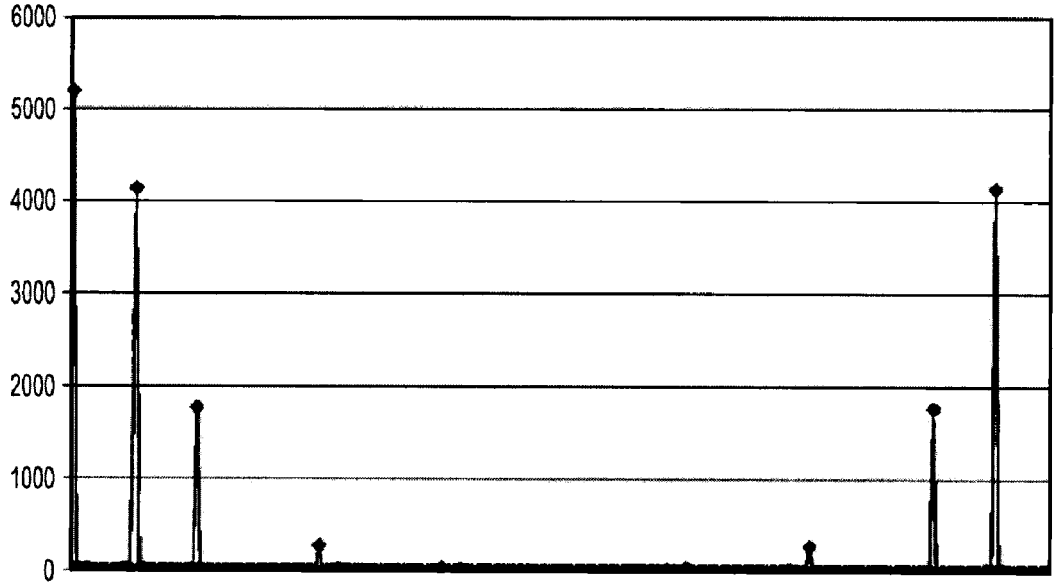
FIG. 7 is a graph illustrating a theoretical FFT for the exemplary MSK synchronization pattern.
Figure 8A:
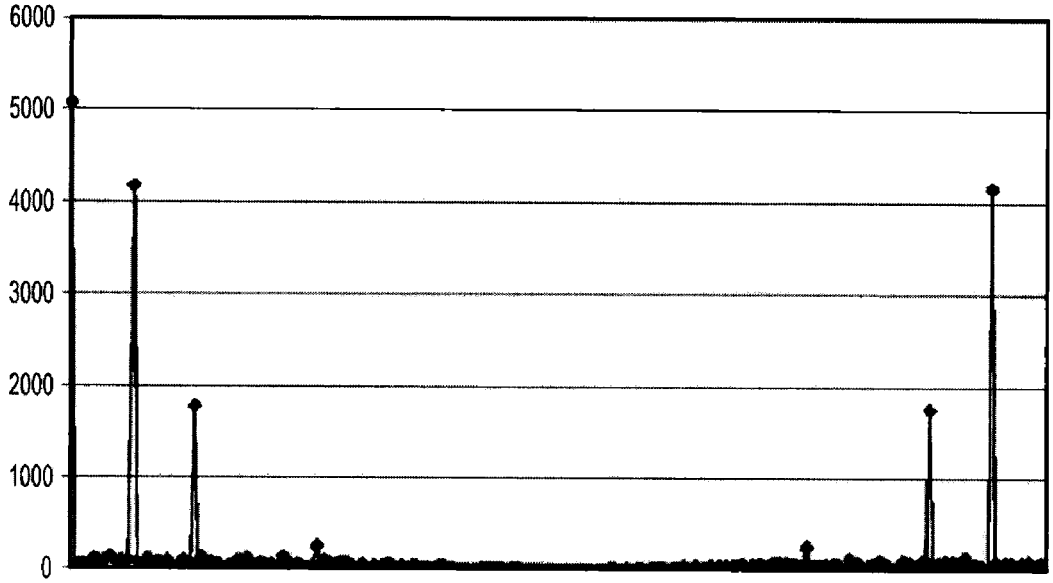
FIGS. 8A and 8B are graphs illustrating the FFT for a received signal having a C/No of 60 and 40, respectively.
Figure 8B:
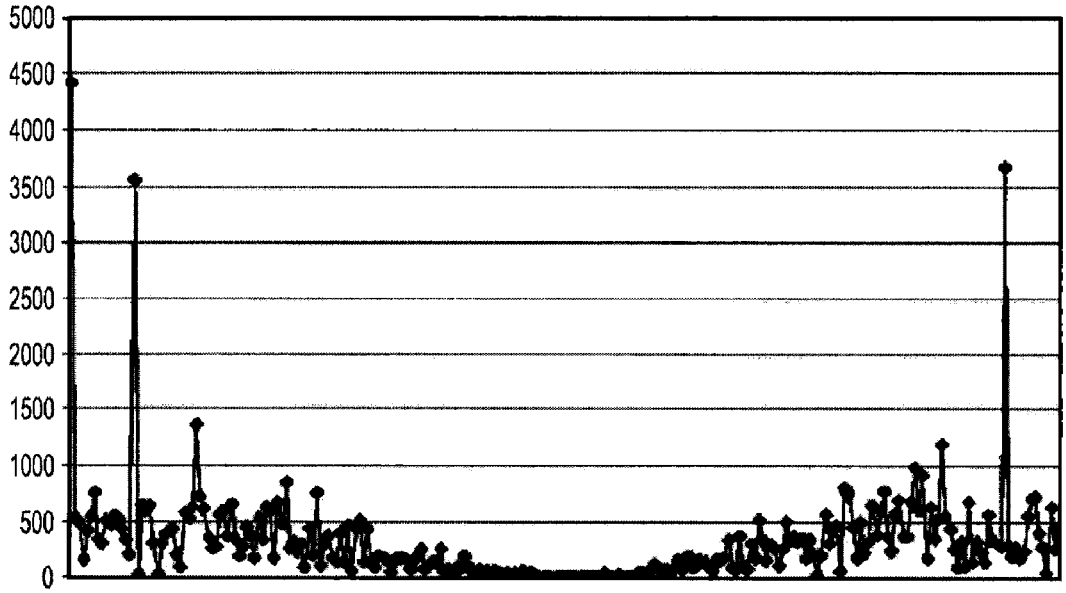
Figure 9A:
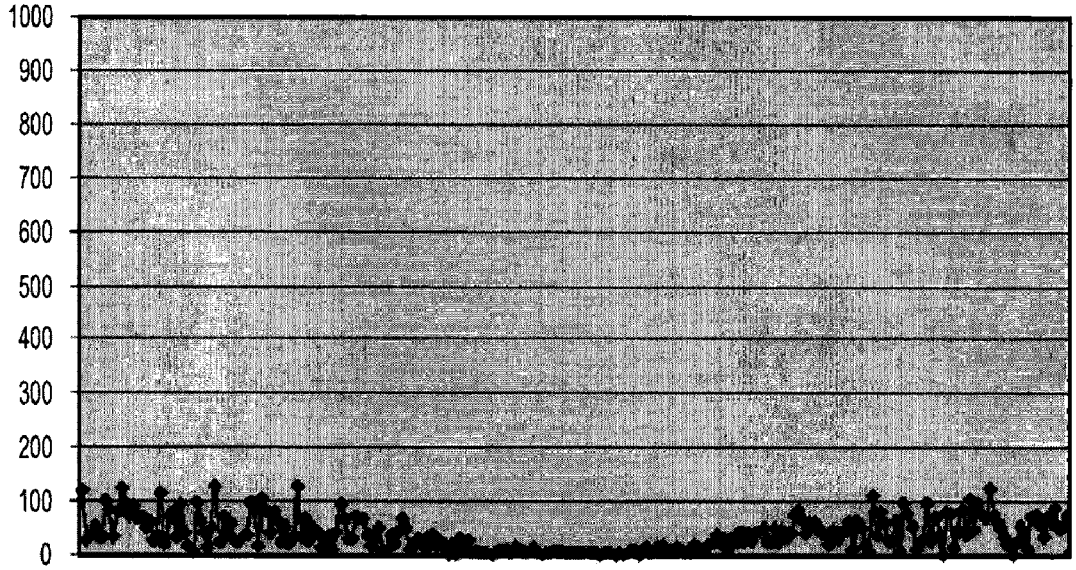
FIGS. 9A and 9B are graphs illustrating the noise component for the received signals having a C/No of 60 and 40, respectively.
Figure 9B:
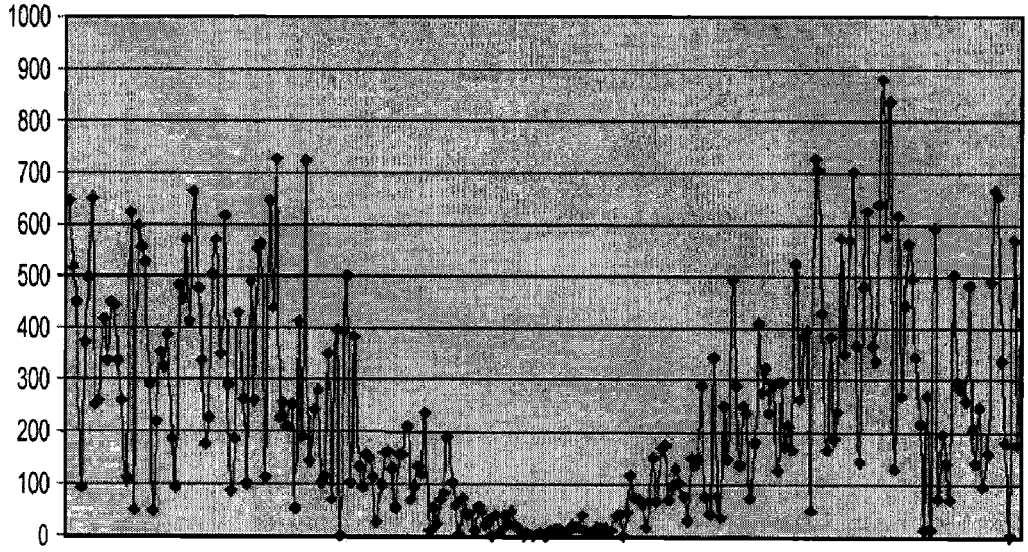
Figure 10:
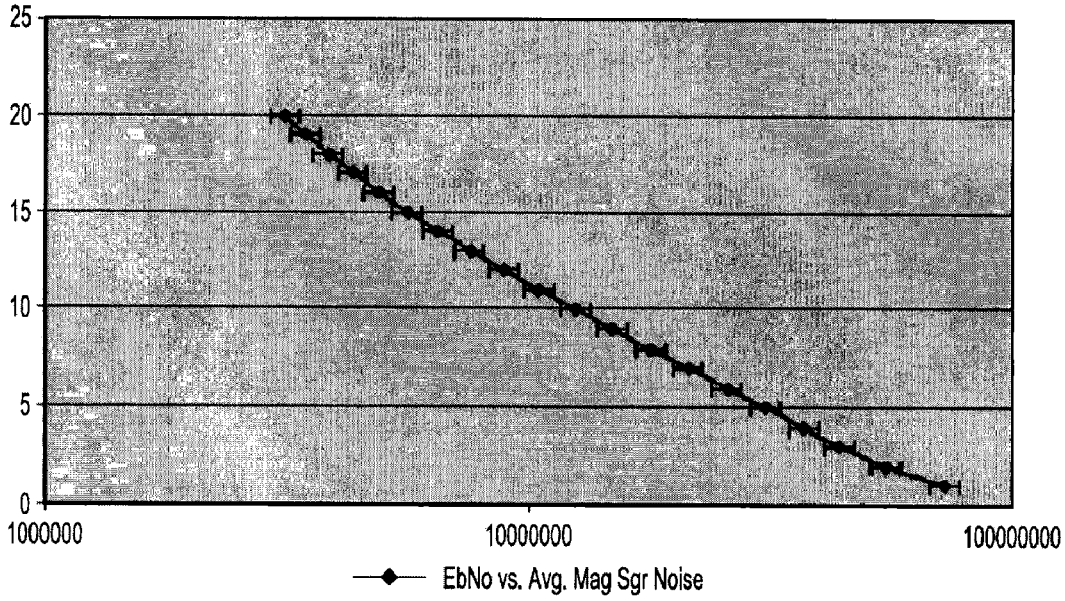
FIG. 10 is a graph illustrating the average sum magnitude of the FFT noise component.

For illustration purposes, the theoretical or expected FFT for the exemplary MSK synchronization pattern is shown in FIG. 7. FIGS. 8A and 8B illustrate the FFT for a received signal having a C/No of 60 and 40, respectively. Subtracting the sum magnitude of each frequency bin of the received signal from the theoretical FFT yields the noise component of the received signal. FIGS. 9A and 9B illustrate the noise component for the received signals having a C/No of 60 and 40, respectively. Thus, as long as the set of samples have been corrected for any Doppler error and the magnitudes normalized, the results of the FFT subtraction will be proportional to the C/No of the channel as shown in FIG. 10. Moreover, the accuracy of these results is within 1 dB-Hz of the actual C/No when the value is between 41 and 60 dB-Hz.

In the exemplary embodiment, each burst transmission has a duration of 0.2 seconds. During execution of the antenna positioning function, a data burst is sent every 0.5 seconds. A metric indicative of signal quality is then computed for each reply transmission received from the satellite. As a result, an indicator of the signal quality can be reported to the radio operator approximately 2 times per second. The radio operator can in turn position the directional antenna of the radio based on the indicator.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A method for positioning a directional antenna, the directional antenna operably connected to a radio, comprising:

receiving an input to the radio, the input indicating a desired time period for positioning the antenna;

transmitting, during the desired time period, a plurality of burst data transmissions from the radio over a channel associated with the satellite;

receiving a plurality of reply data transmissions from the satellite which correspond to the plurality of burst data transmissions sent by the radio;

determining a metric indicative of signal quality for the plurality of reply data transmissions received from the satellite; and outputting from the radio an indicator for the metric which may be used to position the antenna.

2. The method of claim 1 wherein transmitting further comprises generating a data packet having a repeating pattern of data bits for each burst data transmission and modulating the data packets using a digital modulation method.

3. The method of claim 2 further comprises modulating the data packets using a minimum-shift keying method.

4. The method of claim 1 further comprises receiving the plurality of burst data transmissions at a satellite, frequency shifting each of the burst data transmissions and transmitting from the satellite the frequency shifted transmission as a plurality of reply data transmissions.

5. The method of claim 1 wherein determining the metric further comprises transforming each of the reply data transmissions from a time domain to values in a frequency domain and determining the metric indicative of signal quality from the values in the frequency domain.

6. The method of claim 5 further comprising transforming the reply data transmissions using a fast Fourier transform.

7. The method of claim 5 wherein determining the metric further comprises computing a ratio between spectral values at frequencies correlated to expected tones in the reply data transmissions and the remaining spectral values derived from the reply data transmissions.

8. The method of claim 1 further comprises updating the indicator for the metric periodically during the desired time period and outputting the updated indicator from the radio.

9. The method of claim 1 further comprises positioning the directional antenna coupled to the radio based on the indicator output by the radio.

10. A method for positioning a directional antenna towards a satellite, the directional antenna operably coupled to a radio, comprising:

generating at the radio a positioning signal having a repeating pattern of locating data bits;

modulating the positioning signal using a digital modulation method;

transmitting the modulated positioning signal from the radio to the satellite;

receiving a reply signal from the satellite which corresponds to the modulated positioning signal sent by the radio;

transforming the reply signal from a time domain to values in a frequency domain;

determining a metric indicative of signal quality of the reply signal from the values in the frequency domain; and positioning the directional antenna of the radio based on the metric.

11. The method of claim 10 further comprises defining the positioning signal to have a plurality of repeating patterns of locating data bits, each grouping of locating data bits separated by a repeated grouping of bits that uniquely identify the radio.

12. The method of claim 10 further comprises modulating the positioning signal using a continuous phase frequency-shift keying method.

13. The method of claim 10 further comprises receiving the modulated positioning signal at the satellite, frequency shifting the modulated positioning signal and transmitting from the satellite the frequency shifted signal as the reply signal.

14. The method of claim 10 further comprising transforming the reply signal using a fast Fourier transform.

15. The method of claim 10 wherein determining a metric further comprises computing a ratio between spectral values at frequencies correlated to expected tones in the reply signal and the remaining spectral values derived from the reply signal.

16. The method of claim 15 further comprises computing a carrier power to noise spectral density ratio.

17. A radio configured to interface with a directional antenna, comprising:

a user interface configured to receive a desired time period for executing an antenna positioning function;

a transceiver operable to transmit a plurality of burst data transmission from the radio over a channel associated with a satellite during the execution of the antenna positioning function and configured to receive a plurality of reply transmissions from the satellite which correspond to the plurality of burst data transmissions;

a controller in data communication with the user interface and the transceiver, the controller operable to determine a metric indicative of signal quality from the plurality of reply transmissions and output an indicator for the metric periodically during the execution of the antenna positioning function.

18. The radio of claim 17 wherein the controller modulates a data packet using a minimum-shift keying method to generate the burst data transmission, where the data packet includes a repeating pattern of data bits.

19. The radio of claim 18 wherein the controller transforms the plurality of reply transmissions from a time domain to values in a frequency domain using fast Fourier transform.

* * * * *